US008032058B2

(12) United States Patent
Fukuda et al.

(10) Patent No.: US 8,032,058 B2
(45) Date of Patent: Oct. 4, 2011

(54) ELECTROPHOTOGRAPHIC IMAGE FORMING APPARATUS WITH DEVELOPER CARTRIDGE LOCK MEMBER

(75) Inventors: Masayuki Fukuda, Mishima (JP); Eiichiro Kimizuka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 752 days.

(21) Appl. No.: 12/116,483

(22) Filed: May 7, 2008

(65) Prior Publication Data

US 2008/0286003 A1 Nov. 20, 2008

(30) Foreign Application Priority Data

May 15, 2007 (JP) ..... 2007-128985
Apr. 23, 2008 (JP) ..... 2008-112001

(51) Int. Cl.
*G03G 15/04* (2006.01)

(52) U.S. Cl. ..... 399/119; 399/227

(58) Field of Classification Search ..... 399/119, 399/227

See application file for complete search history.

(56) References Cited

U.S. PATENT DOCUMENTS 5,794,103 A * 8/1998 Oh ..... 399/119
6,751,428 B2 6/2004 Okabe
6,834,173 B2 12/2004 Yamaguchi et al.
6,941,093 B2 9/2005 Park et al.
6,947,687 B2 9/2005 Yamaguchi et al.
6,961,528 B2 11/2005 Yamaguchi et al.
7,174,117 B2 2/2007 Okabe
7,369,791 B2 5/2008 Okabe
2004/0190932 A1 * 9/2004 Ishii ..... 399/119
2005/0265746 A1 * 12/2005 Jung et al.
2006/0127129 A1 * 6/2006 Jung et al.
2008/0247776 A1 10/2008 Okabe

FOREIGN PATENT DOCUMENTS

JP 62-209572 A 9/1987
JP 2002-162797 A 6/2002
JP 2003-84645 A 3/2003
JP 2003-202793 A 7/2003
JP 2004-46185 A 2/2004
JP 2005-316282 A 11/2005

OTHER PUBLICATIONS

Japanese Office Action dated Nov. 11, 2008 in Japanese Application No. 2008-112001, and an English-language translation thereof.

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

An electrophotographic image forming apparatus which allows a locking operation to be easily performed even when a lock mechanism for a developing cartridge is provided at a position hard of access for a user. The electrophotographic image forming apparatus includes a cartridge door opening and closing an opening portion for allowing mounting and detachment of the developing cartridge, a lock member which locks the developing cartridge mounted to a mounting portion so that the developing cartridge may not be detached from the mounting portion and which is rotatable to release the lock, and a link member which abuts the lock member and which can rotate to effect switching between the lock and lock releasing of the lock member, with an end portion of the link member being situated in the vicinity of the opening portion.

6 Claims, 9 Drawing Sheets

ELECTROPHOTOGRAPHIC IMAGE FORMING APPARATUS WITH DEVELOPER CARTRIDGE LOCK MEMBER

BACKGROUND OF THE INVENTION

1. Field of the Invention

The present invention relates to an electrophotographic image forming apparatus having a structure in which a developing cartridge for developing an electrostatic latent image formed on an electrophotographic photosensitive member is detachably mounted to a mounting portion.

2. Description of the Related Art

In recent years, an electrophotographic image forming apparatus such as a color laser printer is widely used. There is known a rotary development type image forming apparatus in which a plurality of developing cartridges are mounted to a rotatable rotary. The rotary is rotated to cause the developing cartridges of different colors to be successively opposed to an electrophotographic photosensitive drum, whereby developer images of different colors are formed. Then, a color image is formed on a recording medium. Examples of the electrophotographic image forming apparatus include a copying machine, a printer, and a facsimile apparatus.

There is a demand for a construction which, when replacing the developing cartridges, facilitates the operation of mounting and detaching the developing cartridges with respect to a cartridge mounting portion provided within the apparatus main body. In particular, in the rotary development type image forming apparatus, it is necessary to prevent the developing cartridges mounted to the rotary from being detached from the rotating rotary.

As a construction for preventing detachment of the cartridges from the rotating rotary, there is known a construction in which a gripper for gripping the cartridges and a cartridge lock portion are capable of interlocking (Japanese Patent Application Laid-Open No. 2003-202793).

In the above-mentioned construction, a pair of grippers are provided at the central portion in the longitudinal direction of each cartridge. The grippers are connected to lock portions protruding from both longitudinal end surfaces of the cartridge. Further, the grippers are urged longitudinally outwards.

When mounting the cartridge to the rotary, the user grips the grippers against the urging force. When the user releases the grippers, the lock portions protrude from the side surfaces of the cartridge due to the urging force. Then, the lock portions are engaged with a locking part of the rotary, whereby it is possible to lock the cartridge to the rotary.

On the other hand, when releasing the lock, the user grips the grippers. As a result, the lock portions, which have been protruding outwardly, are accommodated within the cartridge, whereby the lock of the cartridge and the rotary is released.

The above-mentioned related art technique, which can be well adapted to the image forming apparatus sizes as required at that time, has been an excellent one from the viewpoint of practical use. In recent years, however, there is a demand for a further reduction in the size of an image forming apparatus.

SUMMARY OF THE INVENTION

The present invention has been made in view of the above-mentioned problem. It is an object of the present invention to provide an electrophotographic image forming apparatus which, even in a case of an image forming apparatus reduced in size, easily allows a locking operation for locking developing cartridges to an apparatus main body.

Another object of the present invention is to provide an electrophotographic image forming apparatus which, even in the case of an image forming apparatus reduced in size, reliably allows the locking operation for locking the developing cartridges to the apparatus main body.

Still another object of the present invention is to provide an electrophotographic image forming apparatus which, even in the case of an image forming apparatus reduced in size, easily allows a releasing operation for releasing the lock of the developing cartridges locked to the apparatus main body.

In order to solve the above-mentioned problems, the present invention provides an electrophotographic image forming apparatus in which a developing cartridge for developing an electrostatic latent image formed on an electrophotographic photosensitive member is detachably mounted to a mounting portion, the electrophotographic image forming apparatus including: an opening portion through which the developing cartridge is passed when mounting the developing cartridge to the mounting portion and when detaching the developing cartridge from the mounting portion; an openable and closable member movable between an opening position at which the opening portion is opened and a closed position at which the opening portion is closed; a lock member which releasably locks to the mounting portion the developing cartridge mounted to the mounting portion; and a releasing member acting on the lock member to release the lock of the developing cartridge locked to the mounting portion by the lock member.

According to the present invention, it is possible to provide an electrophotographic image forming apparatus which, even in the case of an image forming apparatus reduced in size, easily allows the locking operation for locking the developing cartridges to the apparatus main body.

Further, according to the present invention, it is possible to provide an electrophotographic image forming apparatus which, even in the case of an image forming apparatus reduced in size, reliably allows the locking operation for locking the developing cartridges to the apparatus main body.

Further, according to the present invention, it is possible to provide an electrophotographic image forming apparatus which, even in the case of an image forming apparatus reduced in size, easily allows the releasing operation for releasing the lock of the developing cartridges locked to the apparatus main body.

Further features of the present invention will become apparent from the following description of exemplary embodiments with reference to the attached drawings.

DESCRIPTION OF THE EMBODIMENTS

Next, an electrophotographic image forming apparatus (hereinafter simply referred to as the "image forming apparatus") which performs image formation with a developing cartridge according to an embodiment of the present invention mounted thereto, is described with reference to the drawings.

First Embodiment

Figure 1:
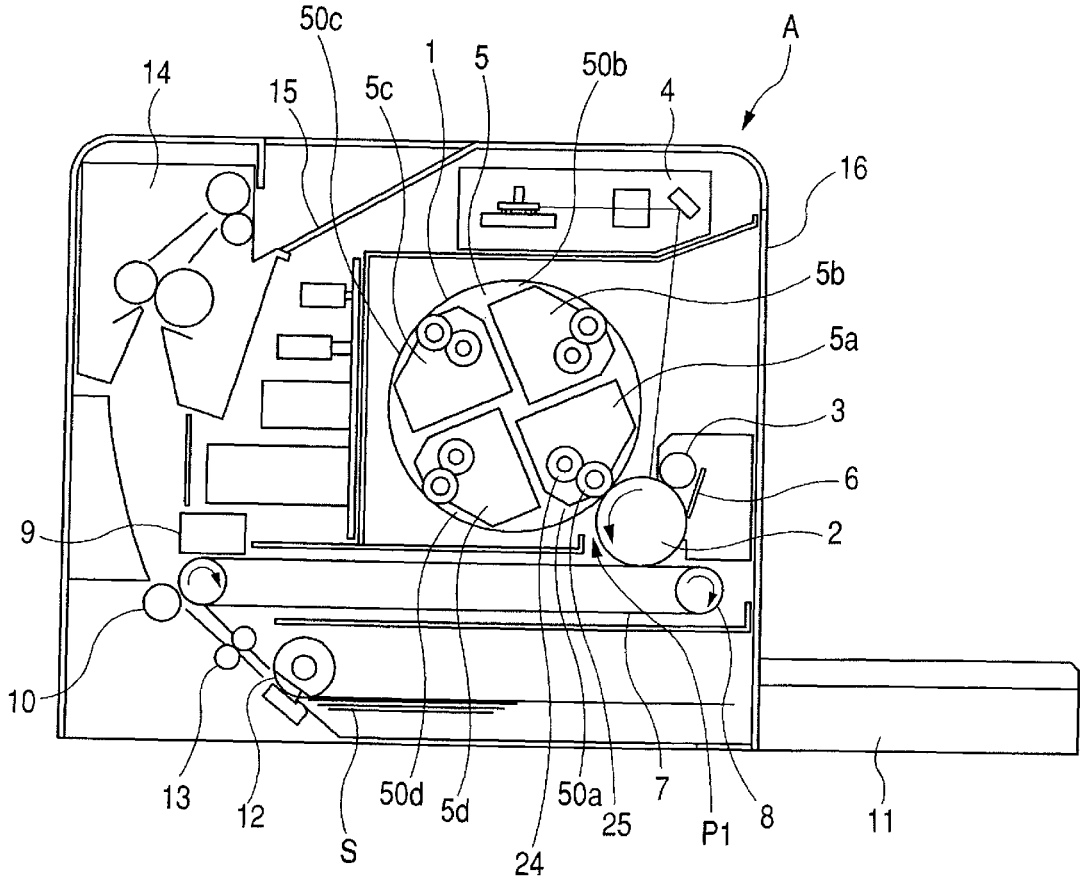
FIG. 1 is a general schematic explanatory view of a four-color full-color laser beam printer constituting an image forming apparatus according to a first embodiment.

FIG. 1 is a general explanatory view of a full-color laser beam printer constituting a color electrophotographic image forming apparatus according to an embodiment of the present invention. First, a general construction of the color electrophotographic image forming apparatus of this embodiment is described with reference to FIG. 1.

(Color Electrophotographic Image Forming Apparatus)

As illustrated in FIG. 1, the color electrophotographic image forming apparatus of this embodiment has substantially at a center thereof a drum-shaped electrophotographic photosensitive member (hereinafter referred to as the photosensitive drum) 2. Arranged around the photosensitive drum 2 are a charging roller 3 for uniformly charging the photosensitive drum 2, and exposure means 4 for applying a laser beam to the photosensitive drum 2 to form an electrostatic latent image. Further, arranged around the photosensitive drum 2 are developing devices (developing cartridges) 5 for developing the electrostatic latent image formed on the photosensitive drum 2 by using a developer (hereinafter referred to as the "toner"), and a cleaning device 6 for removing residual toner on the photosensitive drum 2.

The developing devices of this embodiment are formed as developing cartridges 5 (5*a*, 5*b*, 5*c*, and 5*d*). The developing devices are rotary type developing devices in which the developing cartridges 5 are detachably mounted to a rotatable rotary 1. In this case, the developing cartridges 5*a*, 5*b*, 5*c*, and 5*d* develop the electrostatic latent image formed on the photosensitive drum 2. The developing cartridge 5*a* accommodates yellow toner, and develops the electrostatic latent image with the yellow toner. The developing cartridge 5*b* accommodates magenta toner, and develops the electrostatic latent image with the magenta toner. The developing cartridge 5*c* accommodates cyan toner, and develops the electrostatic latent image with the cyan toner. The developing cartridge 5*d* accommodates black toner, and develops the electrostatic latent image with the black toner. Each developing cartridge 5 has a developing roller 25 for developing the electrostatic latent image.

Figure 2:
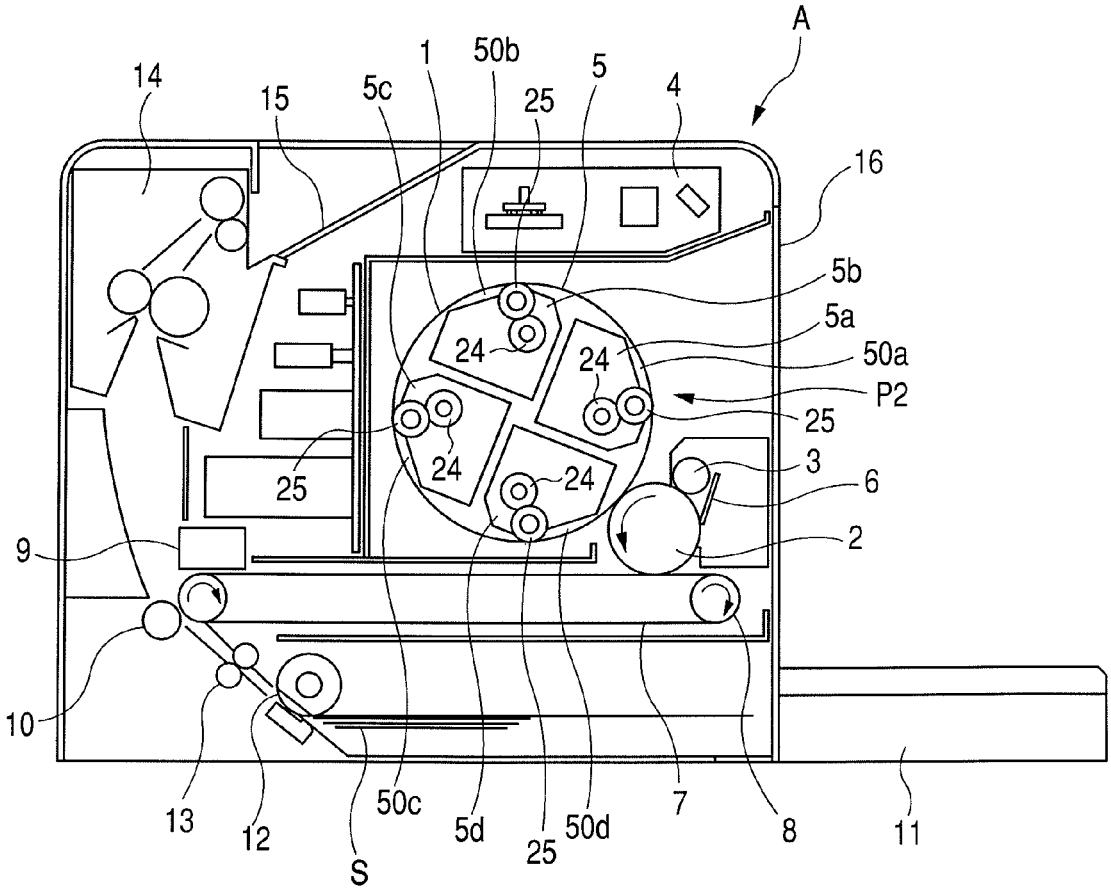
FIG. 2 is an explanatory view illustrating a rotary position for the mounting and detachment of developing cartridges.

When performing image formation, the photosensitive drum 2 is rotated in a direction of an arrow of FIG. 2 (counterclockwise) in synchronism with the running of an intermediate transferring belt 7. The surface of the photosensitive drum 2 is uniformly charged by the charging roller 3. Light application corresponding to a yellow image is performed on the charged photosensitive drum 2 by the exposure means 4, whereby an electrostatic latent image corresponding to the yellow image is formed on the photosensitive drum 2.

Figure 7:
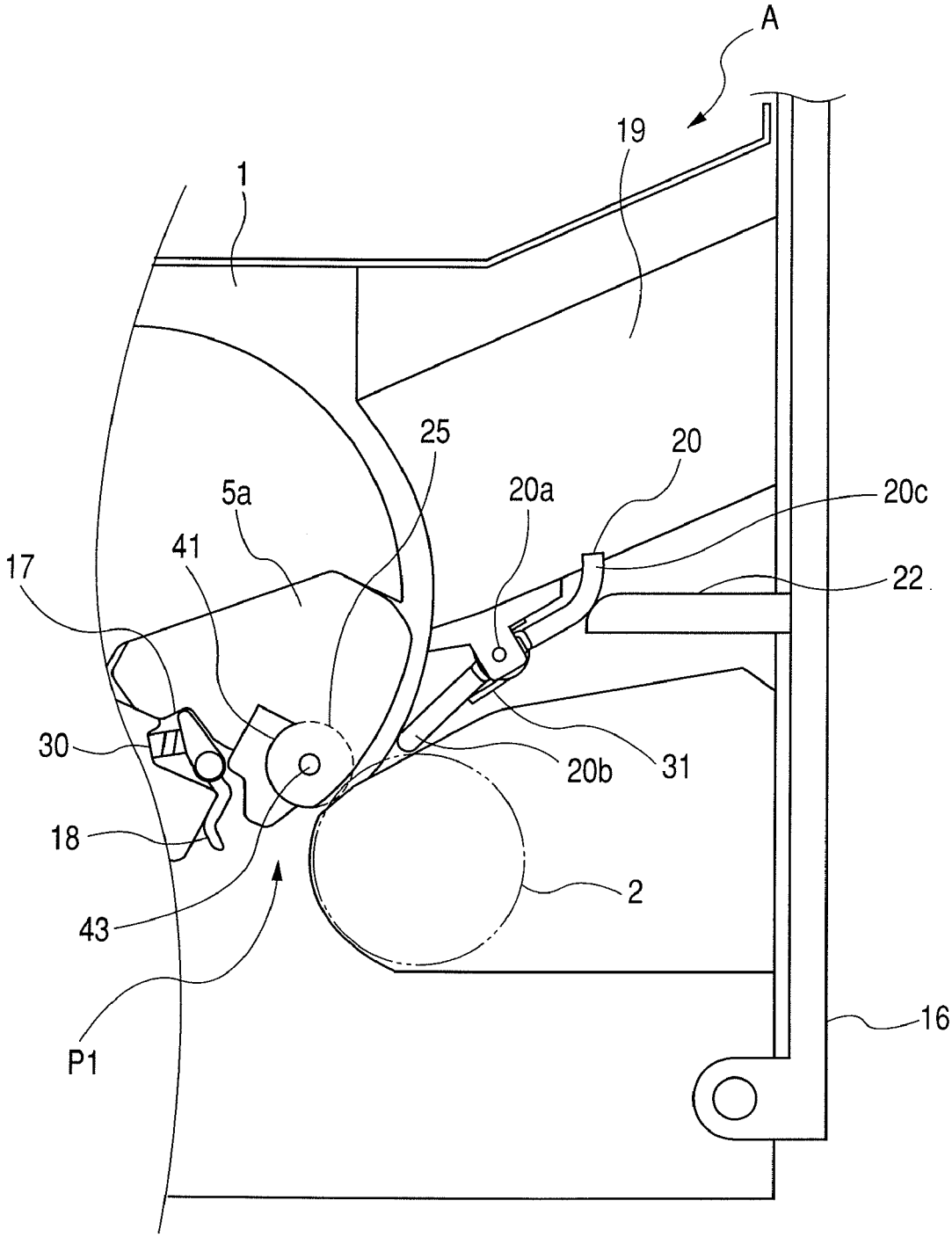
FIG. 7 is a sectional view illustrating the positions of a developing cartridge and a photosensitive drum in FIG. 1.

Simultaneously with the formation of the electrostatic latent image, the rotary 1 is rotated to place the yellow developing cartridge 5*a* at a developing position P1 (FIG. 7). In order to cause yellow toner to adhere to the electrostatic latent image formed on the photosensitive drum 2, there is applied to the developing roller 25 a voltage of the same polarity and substantially the same potential as the electricity with which the photosensitive drum 2 is charged, whereby yellow toner adheres to the electrostatic latent image. That is, the developing roller 25 develops the electrostatic latent image formed on the photosensitive drum 2. Reference numeral 43 indicates a shaft supporting the developing roller 25. The developing roller 25 rotates about the shaft 43.

In this case, FIG. 7 is a sectional view illustrating the positional relationship between the developing cartridge and the photosensitive drum in FIG. 1.

After that, a voltage of a polarity reverse to that of the toner is applied to a primary transfer roller 8 arranged on the inner side of the transferring belt 7. As a result, primary transfer of the yellow toner image formed on the photosensitive drum 2 to the transferring belt 7 is effected.

Similarly, the rotary 1 is rotated to successively cause the magenta, cyan, and black developing cartridges 5*b*, 5*c*, and 5*d* to be opposed to the photosensitive drum 2. Thus, the developing cartridges 5 are successively placed at the developing position P1, where they are opposed to the photosensitive drum 2. Then, toner images developed in the toners of the different colors are transferred onto the transferring belt 7 so as to be superimposed one upon the others, whereby a color image is formed on the transferring belt 7.

While the toner images are transferred to the transferring belt 7, a secondary transfer roller 10 is spaced apart from the transferring belt 7. Further, a cleaning unit 9 for performing cleaning on the transferring belt 7 is also spaced apart from the transferring belt 7.

On the other hand, in synchronism with the above image forming operation, a sheet S constituting a recording medium is transported to the image forming portion by transporting means. In this embodiment, sheets S are stacked together and accommodated in a cassette 11 provided in the lower portion of the apparatus. In synchronism with the image forming operation, the sheets S in the cassette 11 are fed one by one by a feed roller 12. The sheets S thus fed are sent to a secondary transfer portion between the transferring belt 7 and the transfer roller 10 by a registration roller pair 13.

In this case, the recording medium is one on which a toner image is to be formed; it consists of a paper sheet, an OHP sheet or the like.

A voltage of a polarity reverse to that of the toner is applied to the transfer roller 10. The four-color toner images superimposed one upon the others on the transferring belt 7 collectively undergo secondary transfer onto the surface of the transported sheet S.

The sheet S to which the toner image has been transferred is sent to a fixing device 14. In the fixing device 14, the sheet S is heated and pressurized, and the toner images transferred thereto are fixed to the sheet S, whereby an image is formed on the sheet S. The sheet S passes through the fixing device 14, and is delivered onto a delivery portion on an upper cover 15 outside the apparatus.

(Cartridge Locking Means)

The rotary 1 is provided with a plurality of (four, in this embodiment) mounting portions 50*a*, 50*b*, 50*c*, and 50*d* allowing the developing cartridges to be detachably mounted. The four developing cartridges 5*a*, 5*b*, 5*c*, and 5*d* are detachably mounted to the rotary 1. That is, the developing cartridges 5*a*, 5*b*, 5*c*, and 5*d* are detachably mounted to the mounting portions 50*a*, 50*b*, 50*c*, and 50*d* of the rotary 1 by the user.

A plurality of mounting portions 50*a* to 50*d* are provided on the rotary 1 rotatably provided in the main body A of the image forming apparatus. As the rotary 1 rotates, the cartridges 5, which are detachably mounted to the mounting portions 50*a* to 50*d*, move to the developing position P1, where they are opposed to the photosensitive drum 2.

The four developing cartridges 5*a*, 5*b*, 5*c*, and 5*d* only differ from each other in toner color, and they are of the same construction. Each of the developing cartridges 5*a*, 5*b*, 5*c*, and 5*d* has within a cartridge frame a developing means for developing the latent image formed on the photosensitive drum 2 by using toner. The developing means includes an accommodating portion for accommodating toner, a toner feeding roller 24 for feeding the toner in the accommodating portion, and the developing roller 25 for supplying the fed toner to the photosensitive drum 2 to develop the latent image.

When the toner has been consumed, the developing cartridges 5 (5*a*, 5*b*, 5*c*, and 5*d*) are replaced by new developing cartridges by the user. This embodiment adopts a construction in which, in order that the mounted developing cartridges may not be detached from the mounting portions 50 (50*a*, 50*b*, 50*c*, and 50*d*) of the rotary 1 when the rotary 1 rotates during development, the developing cartridges 5 are locked to the mounting portions 50 (the rotary 1). In this embodiment, the locking of the developing cartridges or the releasing of the lock thereof is interlocked with the mounting and detachment of the cartridges.

Next, the construction of the cartridge locking means is described with reference to the case in which the yellow developing cartridge 5*a* is mounted and detached. The same construction is adopted for the other cartridges 5.

As illustrated in FIG. 2, through rotation of the rotary 1, the developing cartridge 5*a* is placed at a detaching and mounting position P2, which is a position different from the developing position P1. The developing position P1 is the position where the developing roller 25 is opposed to the photosensitive drum 2 (FIGS. 1 and 7). At the developing position P1, the developing roller 25 comes into contact with the photosensitive drum 2. In this process, a positioned portion 42 abuts a development positioning rib (main body side positioning portion) 41 within the rotary 1, whereby positioning of the cartridge 5*a* with respect to the rotary 1 is effected. The phase of the cartridge detaching and mounting position P2 is determined such that none of the cartridges 5 mounted to the rotary 1 exists at the developing position P1 during mounting or detachment. That is, in the state illustrated in FIG. 3, the cartridge 5*a* is situated at a position where it is opposed to a door 16. In this state, the operator opens the cartridge door (openable and closable member) 16 when detaching the cartridge 5*a* from the rotary 1 (mounting portions 50*a* to 50*d*). The door 16 is mounted so as to be rotatable about a fulcrum 16*a* with respect to the apparatus main body A to open and close an opening portion 40. When the cartridge 5*a* is detached from the rotary 1 (mounting portions 50*a* to 50*d*), the cartridges 5*a* passes through the opening portion 40. It is the same when the cartridge 5*a* is mounted to the rotary 1.

When mounting the cartridges 5 to the mounting portions 50*a* to 50*d* and when detaching the cartridges 5 from the mounting portions, the cartridges 5 pass through the opening portion 40. The door 16 can move between an opening position where it opens the opening portion 40 and a closed position where it closes the opening portion 40.

The positioned portion 42 serves to effect positioning on the cartridges 5*a* to 5*d* with respect to the mounting portions 50*a* to 50*d*. The positioned portion 42 is provided coaxially with the developing roller 25 and on the outer surface of the cartridge frame. In this embodiment, the positioned portion 42 is of a columnar configuration. The mounting portions 50*a* to 50*d* are provided with the rib (main body side positioning portion) 41. The rib 41 comes into contact with the positioned portion 42 of the cartridge 5 mounted to the rotary 1. As a result, positioning is effected on the cartridge 5 with respect to the rotary 1, with the developing roller 25 being at the center. The rib 41 is of an arcuate (circular arc) configuration. Thus, positioning is effected on the positioned portion 42 of a columnar configuration by the rib 41 of an arcuate configuration.

When mounting or detaching the cartridges 5 to or from the mounting portions 50*a* to 50*d* (the rotary 1), the operator grasps a gripping portion 44. Holding the gripping portion 44, the operator carries the cartridges 5.

The detaching and mounting position P2 is a position where the cartridges 5 mounted to the rotary 1 can be taken out of the apparatus main body A via the opening portion 40. Further, the detaching and mounting position P2 is a position where, in mounting the cartridges 5 to the rotary 1, it is possible to guide the cartridges 5 to the interior of the apparatus main body A via the opening portion 40.

Figure 3:
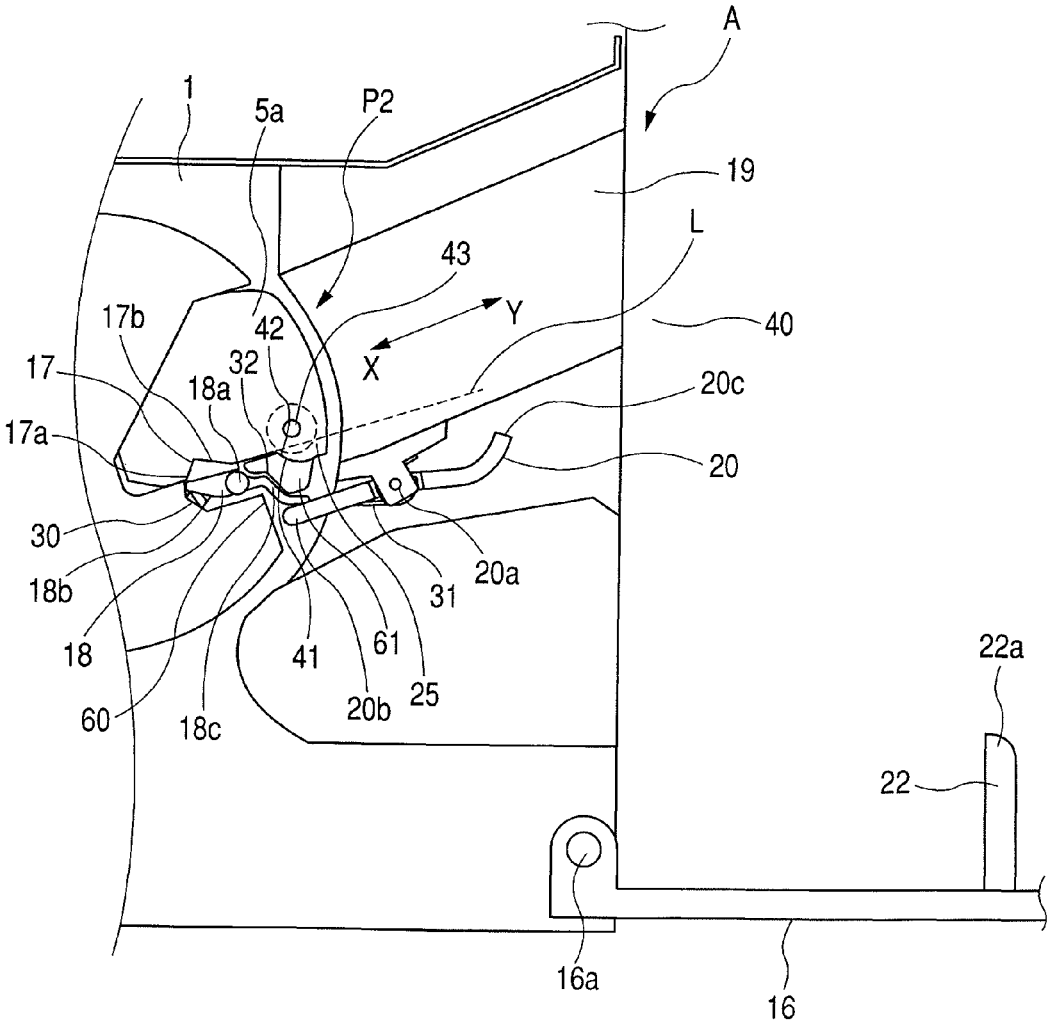
FIG. 3 is an explanatory sectional view illustrating a state in which a cartridge door is open, with the lock of the developing cartridge with respect to the rotary being released.

FIG. 3 is an explanatory sectional view illustrating a state in which the door 16 is open; in this state, the lock of the cartridge 5*a* with respect to the rotary 1 has been released.

As illustrated in FIG. 3, a lock member 18 serving as a locking means is provided so as to be rotatable about a fulcrum 18*a*. The lock member 18 is urged clockwise (in FIG. 3) by a compression spring (lock urging unit) 30 resiliently urging the lock member 18 so as to lock the cartridge 5*a*. In this way, the lock member 18 serves to lock the cartridges 5, mounted to the mounting portions 50*a* to 50*d*, releasably to the mounting portions.

On the other hand, the developing cartridge 5*a* is provided with a lock engagement portion (locked portion) 17 of a recessed configuration into which the rotation forward end of the lock member 18 can be inserted. As illustrated in FIG. 3, when the lock member 18 is not engaged with the lock engagement portion 17, the lock of the cartridge 5*a* by the lock member 18 has been released. As a result, the cartridge 5*a* is detachable with respect to the mounting portion 50*a*, 50*b*, 50*c*, 50*d* while guided by a cartridge guide portion 19 provided in the apparatus main body A.

As described above, in order to develop an electrostatic latent image formed on the photosensitive drum 2, the cartridge 5 has the developing roller 25 for supplying developer to the photosensitive drum 2. Further, in order to effect positioning on the cartridges 5 with respect to the mounting portions 50*a* to 50*d*, each cartridge 5 has the positioned portion 42 provided coaxially with the developing roller 25, and the lock engagement portion 17 to be engaged with the lock member 18 when the cartridge 5 is mounted to the mounting portion. With the cartridge 5 being mounted to the mounting portion, the lock engagement portion 17 is provided on the lower surface of the cartridge 5. Further, with the cartridge 5 being mounted to the mounting portion, the lock engagement portion 17 is provided on the downstream side of the developing roller 25 with respect to a mounting direction X in which the cartridge 5 is mounted to the mounting portion.

Further, the positioned portion 42 for effecting positioning on the cartridge 5 with respect to the rotary 1 and the lock engagement portion 17 for locking the cartridge 5 to the rotary 1 are provided in a detaching and mounting line L (phantom line) of the cartridge 5 (FIGS. 2 to 5). The detaching and mounting line L indicates the movement path for the cartridge, along which the cartridge 5 is mounted or detached to or from the rotary 1.

Thus, according to this embodiment, it is possible to perform positioning accurately on the developing roller 25 with respect to the mounting portions 50*a* to 50*d*. That is, it is possible to mount the developing roller 25 to the rotary 1 while involving little play. Thus, during rotation of the rotary 1, it is possible to suppress positional deviation of the developing roller 25. Thus, the developing roller 25 can be accurately brought into contact with the photosensitive drum 2. Thus, it is possible to mitigate the impact when the developing roller 25 and the photosensitive drum 2 are brought into contact with each other.

Figure 4:
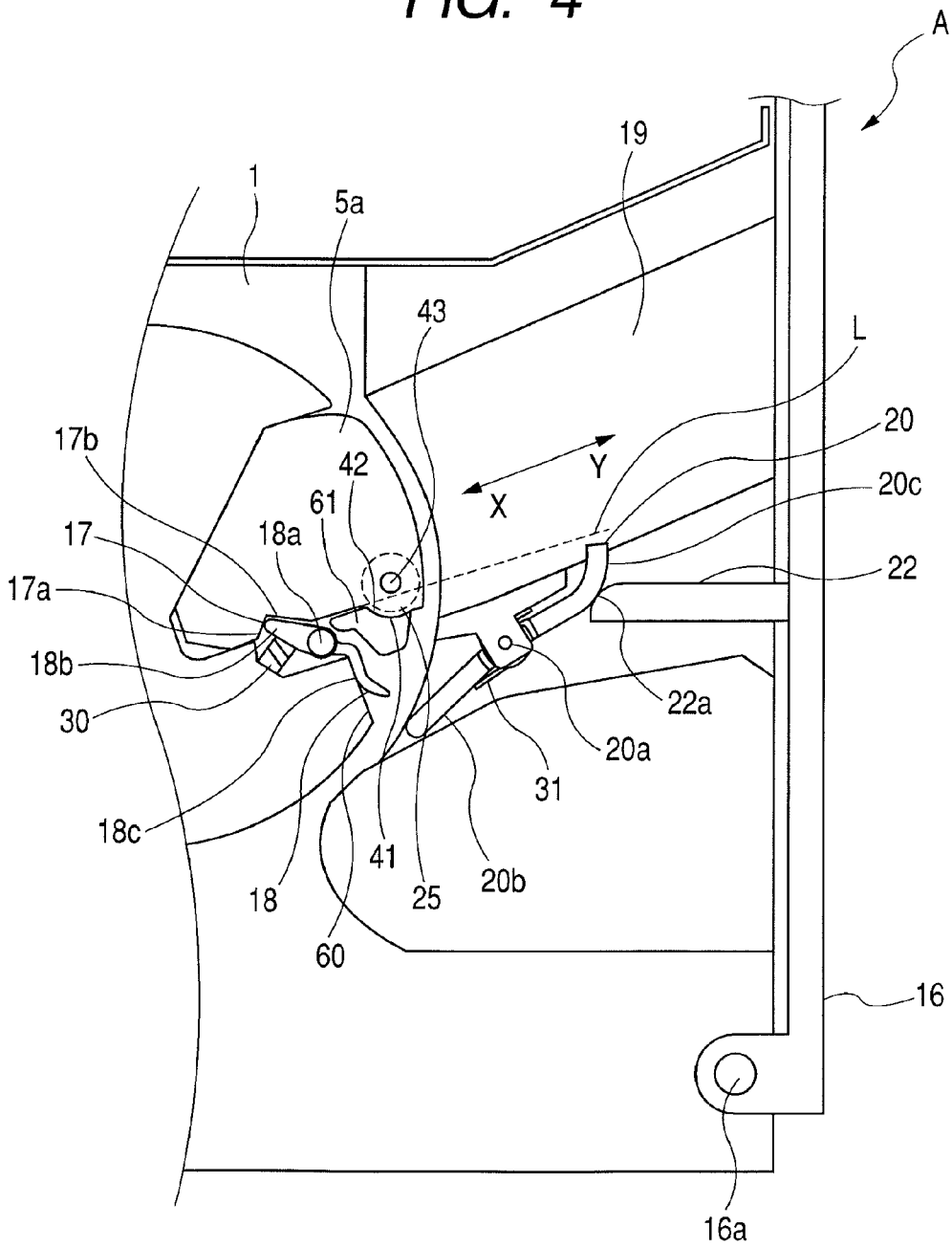
FIG. 4 is an explanatory sectional view illustrating a state in which a cartridge door is closed with respect to a main body, with a developing cartridge 5*a* being locked to the rotary.

On the other hand, as illustrated in FIG. 4, in the state in which the lock member 18 is rotated to be engaged with the lock engagement portion 17, when the cartridge 5*a* is inclined to be detached in the direction of an arrow Y, the forward end of the lock member 18 interferes in the lock engagement portion 17. Thus, if the rotary 1 rotates, the cartridge 5*a* is not detached from the rotary 1. That is, the cartridge 5*a* is locked to the rotary 1 so as not to be detached therefrom.

In this embodiment, the lock engagement portion 17 is situated on the lower surface of the cartridge 5*a* while mounted to the rotary 1. The recess configuration of the lock engagement portion 17 is as follows: in the state in which the cartridge 5*a* is mounted to the rotary 1, the lock engagement portion has a downward slope 17*a* extending from the downstream side toward the upstream side and an upward slope 17*b* extending from the downstream side toward the upstream side with respect to the mounting direction X in which the cartridge 5*a* is mounted to the rotary 1. The connecting portion between the two slopes 17*a* and 17*b* is the deepest. When the cartridge 5*a* is inclined to be detached in the direction indicated by the arrow Y, the forward end 18*b* of the lock member 18 comes into contact with the slope 17*b*. In this state, the other end 18*c* of the lock member 18 comes into contact with a stopper 60. As a result, rotation of the lock member 18 is regulated. Thus, the lock member 18 prevents the cartridge 5*a* from being detached from the rotary 1. Further, the lock engagement portion 17 has the above-mentioned slopes 17*a* and 17*b*, so when the cartridge 5*a* is inclined to be detached in the direction indicated by the arrow Y, the forward end of the lock member 18 interferes in the lock engagement portion 17. As a result, it is possible to effect locking of the cartridge 5*a* with respect to the rotary 1 more reliably. That is, it is possible to regulate movement of the cartridge 5*a*.

The length of the other end portion 18*c* of the lock member 18 is set so as to be within the rotation region of the rotary 1. As a result, in the locked state, the lock member 18 does not interfere with the rotation of the rotary 1.

Figure 8:
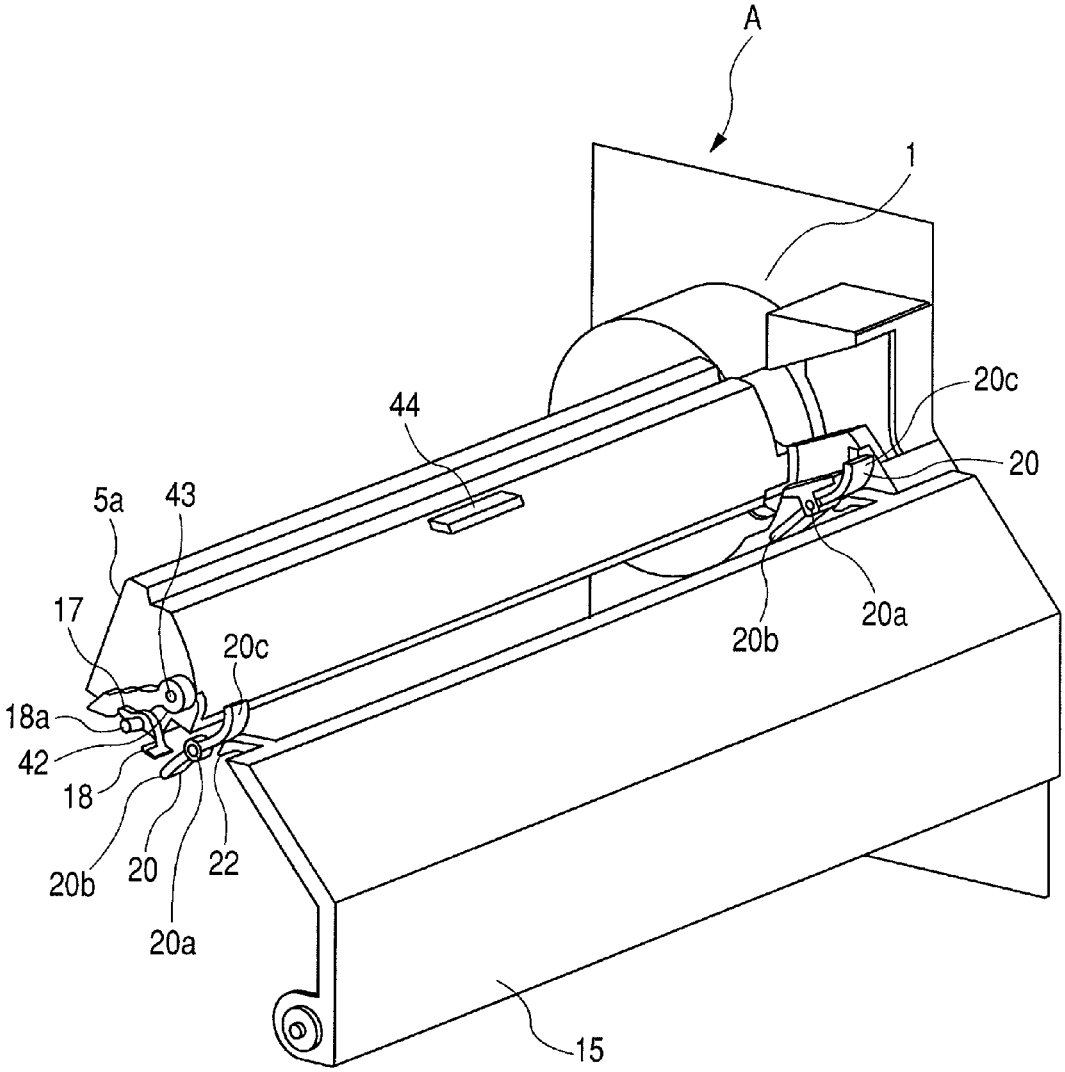
FIG. 8 is a perspective view illustrating a state in which a cartridge door is open, with the lock of the developing cartridge with respect to the rotary being released.
Figure 9:
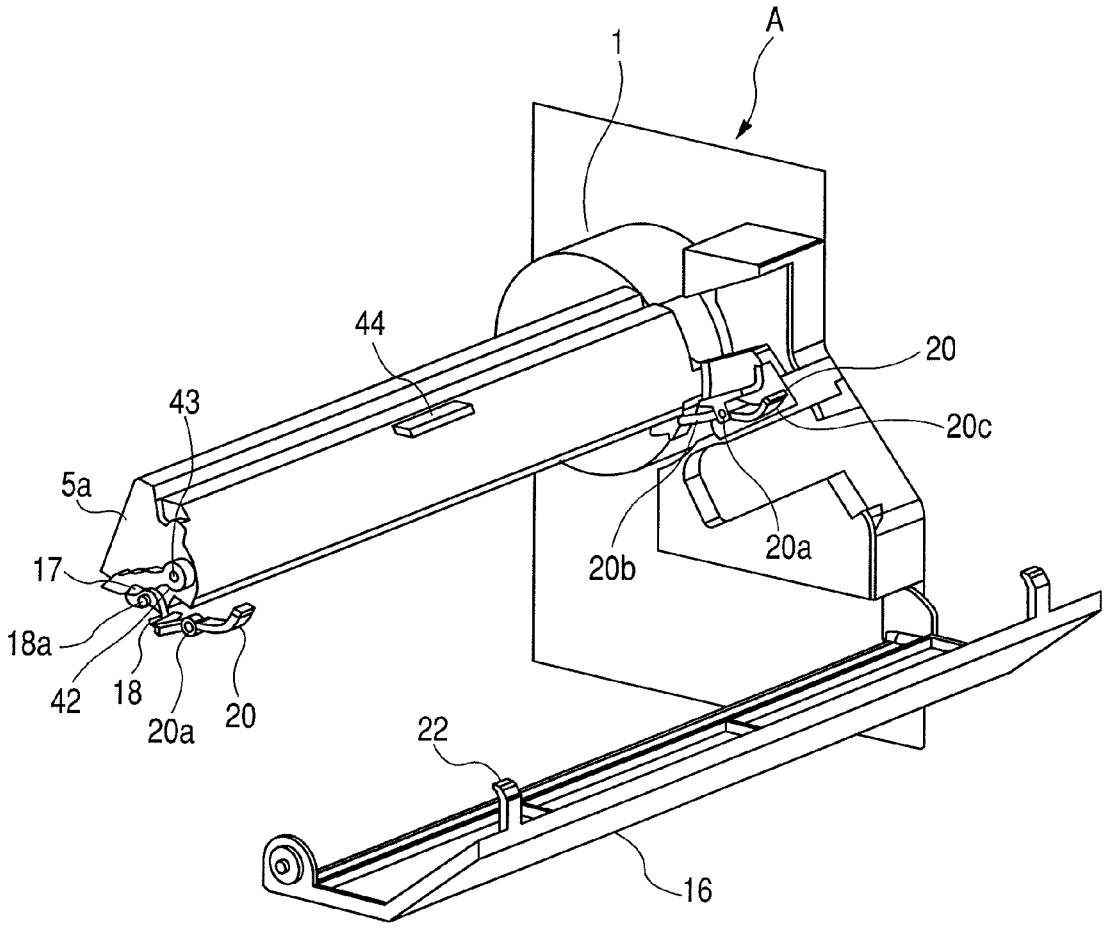
FIG. 9 is a perspective view illustrating a state in which a cartridge door is closed with respect to the main body, with the developing cartridge 5*a* being locked to the rotary.

FIG. 8 is a perspective view illustrating a state in which the door 16 is open. The figure illustrates a state in which the lock of the cartridge 5*a* with respect to the rotary 1 has been released. FIG. 9 is a perspective view illustrating a state in which the door 16 is closed with respect to the main body A.

The figure illustrates a state in which the cartridge 5*a* is locked to the rotary 1.

(Lock Link Means)

As described above, the other end 18*c* of the lock member 18 is within the rotation region of the rotary 1. Thus, when the rotary 1 is arranged on the depth side of the apparatus main body A, it is rather difficult for the operator (user) to directly operate the lock member 18. Further, in this embodiment, there is provided a link means which comes into contact with the lock member 18 to effect switching between the lock of the developing cartridge and the releasing of the lock by the lock member 18. As illustrated in FIG. 3, the link means of this embodiment has a link member (releasing member) 20 rotatable about a fulcrum 20*a* provided on the guide portion 19.

Further, mounted to the fulcrum 20*a* is an urging spring (link urging unit) 31 for urging the link member 20 such that the lock member 18 rotates so as to release the lock. The link member 20 is urged clockwise (FIG. 3) by the elastic force of the spring 31. In this way, the link member (releasing member) 20 acts on the lock member 18 in order to release the lock of the cartridges 5 locked to the mounting portions 50*a* to 50*d* by the lock member 18.

Setting is made such that the urging moment acting on the link member 20 is made reliably larger than the urging moment acting on the lock member 18.

One end portion 20*b* of the link member 20 is mounted to the guide portion 19 so as to push up the other end portion 18*c* of the lock member 18. Thus, in the state in which the door 16 is open (the state illustrated in FIGS. 3 and 9), the forward end 20*b* of the link member 20 pushes up the other end portion 18*c* of the lock member 18. Thus, the lock member 18 rotates counterclockwise. As a result, the forward end 18*b* of the lock member 18 is separated from the recessed space of the lock engagement portion 17, and the state in which the lock is released is attained.

The rotary 1 is provided with a rotation regulating portion (regulating portion) 32. Thus, counterclockwise rotation of the rotary 1 is regulated through contact with the rotation regulating portion 32. That is, the lock member 18 ceases to rotate by coming into contact with the rotation regulating portion 32.

In this embodiment, there is provided a main body member 61 integrally having the positioned portion 41 and the rotation regulating portion 32 for regulating the range of rotation in a direction reverse to that in which the lock member 18 locks the cartridges 5 to the mounting portions 50*a* to 50*d* (FIGS. 3 to 6).

In this way, the main body member 61 integrally includes the positioned portion 41 and the rotation regulating portion 32, so it is only necessary to mount to the apparatus main body A a component (the main body member 61) of which positional accuracy is required at the time of mounting to the apparatus main body A. That is, there is no need to perform the operation of separately mounting to the apparatus main body A a component having the positioned portion 41 and a component having the rotation regulating portion 32. Thus, it is possible to achieve an improvement in terms of assembly workability.

FIG. 4 is an explanatory sectional view illustrating a state in which the door 16 is closed with respect to the main body A. FIG. 4 illustrates a state in which the developing cartridge 5*a* is locked to the rotary 1. FIG. 8 is a perspective view thereof.

In this embodiment, the locked state and the lock-released state of the lock member 18 are interlocked with the operation of opening and closing the door 16. Thus, a rib (contact portion or protruding member) 22 for rotating the link member 20 is provided on the inner side of the door 16. As illustrated in FIG. 4, when the door 16 is closed, the rib 22 pressurizes the end portion 20*c* of the link member 20, causing the link member 20 to rotate counterclockwise against the elastic force of the urging spring 31.

As the link member 20 rotates, the link member 20 is brought out of contact with the lock member 18. That is, the link member 20 is separated from the lock member 18. At the same time, the lock member 18 rotates clockwise due to the urging force (elastic force) of the compression spring 30. The forward end 18*b* of the lock member 18 enters the space of the lock engagement portion 17 provided on the cartridge 5*a*. As a result, the cartridge 5*a* is placed in the locked state in which the cartridge 5*a* is locked to the mounting portion 50*a* by the lock member 18. As a result, in the state in which the door 16 is closed, the cartridge 5*a* is fixed to the rotary 1.

Further, as illustrated in FIG. 3, the other end 20*c* (the end portion on the side opposite to the side held in contact with the lock member 18) of the link member 20 of this embodiment is situated in the vicinity of the opening portion 40 in the state in which the door 16 is open. That is, the link member 20 is arranged so as to extend from the depth side toward the front side of the apparatus main body A. Thus, if the lock member 18 is arranged on the depth side of the apparatus, the lock member 18 can be easily operated from the opening portion 40 through operation of the link member 20. Thus, it is not necessary for the rib 22 provided on the inner surface of the door 16 for opening and closing the opening portion 40 to be elongated. The locking and lock-releasing of the cartridge can be interlocked with the operation of opening and closing the door 16.

As described above, to release the lock by the link member 20, the operator moves the door 16 from the closed position to the opening position, whereby the lock member 18 rotates about the fulcrum 18*a*. To release the lock, the link member 20 pushes the lock member 18 such that the lock member 18 is separated from the lock engagement portion 17 of the cartridge 5.

In the above-mentioned embodiment, the link member 20 acts on the lock member 18, so, in connection with the pushing of the lock member 18 by the link member 20, the portion of the link member 20 pushed by the rib 22 provided so as to protrude from the inner side of the door 16 (the rear end 20*c*), and the portion of the rib 22 pushing the link member 20 (the forward end 22*a*) are of an arcuate configuration. As a result, the link member 20 and the rib 22 can be reliably engaged with each other. Further, the link member 20 can reliably rotate about the fulcrum 20*a*.

In the image forming apparatus of this embodiment, the length of the rib (protruding member) 22 provided on the door 16 is approximately 20 mm.

In this case, the position in the vicinity of the opening portion 40 where the other end 20*c* of the link member 20 is situated is a position allowing the operator (user) to easily perform operation from the opening portion 40 while holding the other end of the link member 20, with the door 16 being open.

In a case in which the door 16 also serves to control an interlock switch, the interlock switch is turned ON by closing the door 16, whereby it is possible to start the driving of the apparatus main body A. In this regard, in this embodiment, when the switch is ON, with the door 16 being closed, all the cartridges 5*a*, 5*b*, 5*c*, and 5*d* are in the locked state without fail. Thus, it is possible to reliably prevent the drive of the apparatus main body A from being started, with the cartridges 5*a*, 5*b*, 5*c*, and 5*d* being unlocked.

While the above embodiment is described with reference to the cartridge 5*a*, the same thing applies to the other cartridges.

Second Embodiment

Next, an apparatus according to a second embodiment is described with reference to FIGS. 5 and 6. A basic construction of the apparatus of this embodiment is the same as that of the above-mentioned embodiment, so a redundant description thereof is omitted, and the following description centers on features of this embodiment. The members of the same function as those of the above-mentioned embodiment are indicated by the same reference numerals.

In the first embodiment, the link member 20 is interlocked with the opening and closing of the door 16. In this embodiment, the link member 20 is operated by the user.

Figure 5:
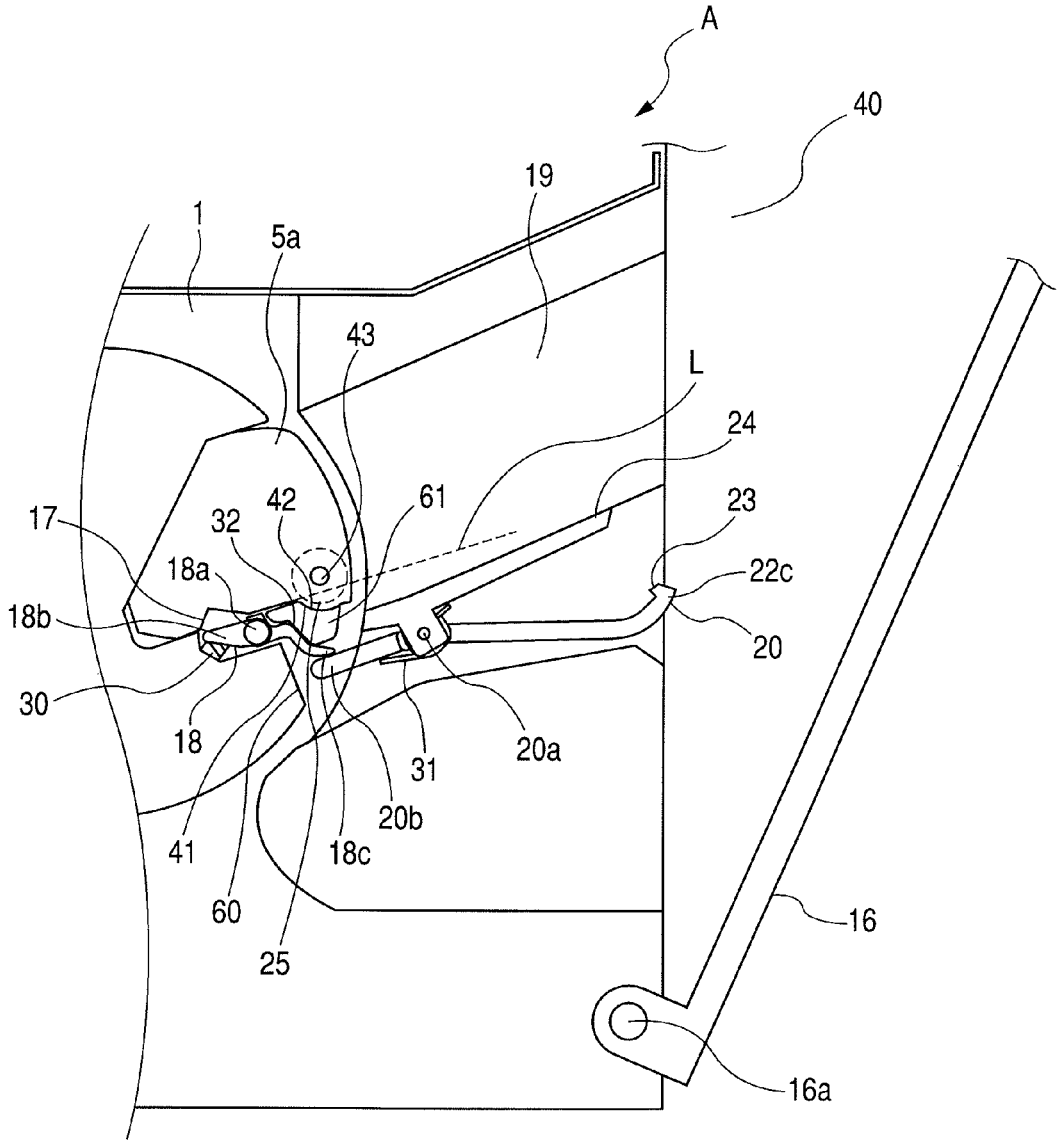
FIG. 5 is an explanatory sectional view illustrating a state in which the lock of a developing cartridge according to a second embodiment has been released.

FIG. 5 is an explanatory sectional view of a developing cartridge according to the second embodiment as unlocked. FIG. 6 is an explanatory sectional view illustrating the developing cartridge according to the second embodiment as locked.

Figure 6:
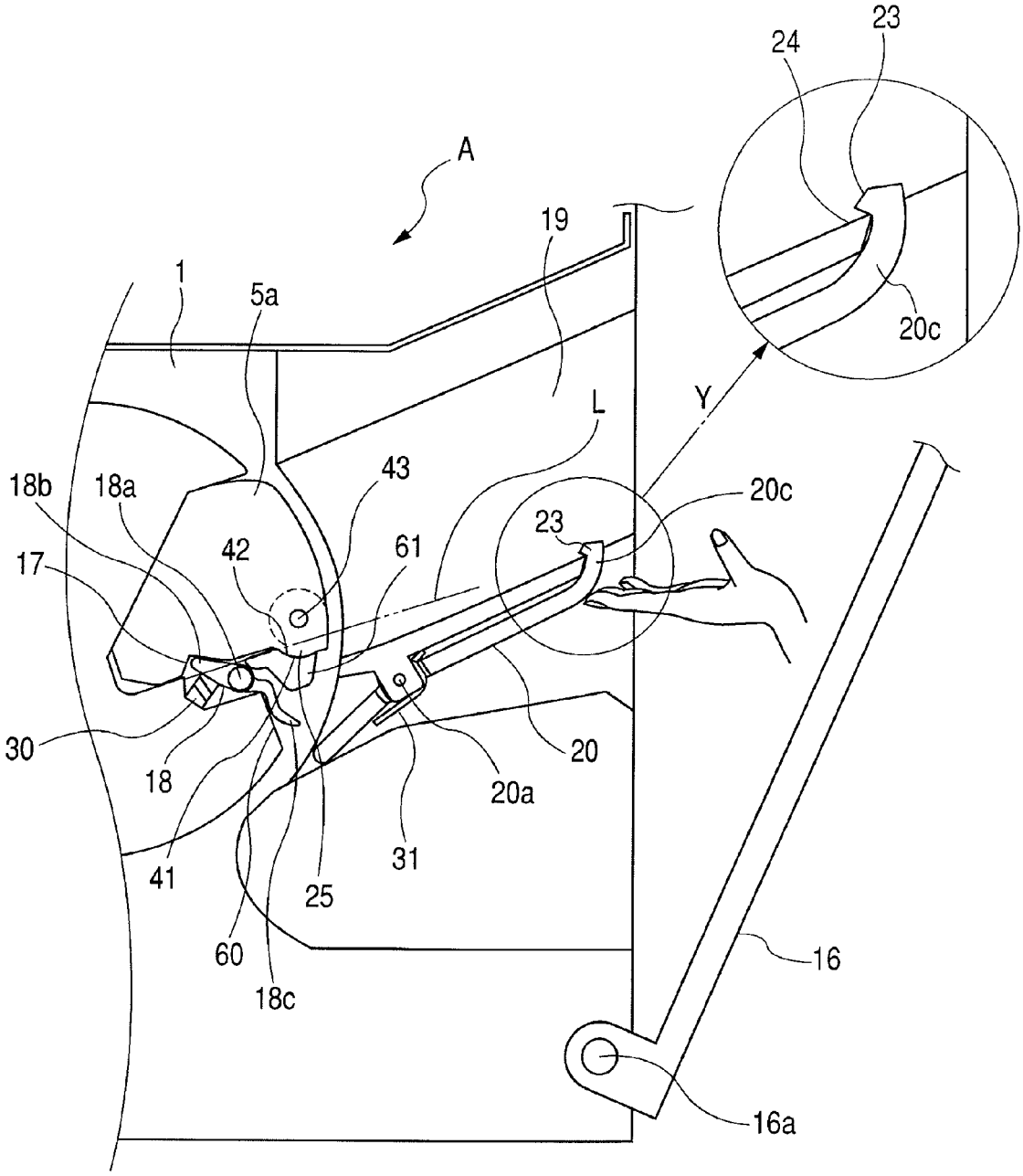
FIG. 6 is an explanatory sectional view illustrating the developing cartridge of the second embodiment as locked.

As illustrated in FIGS. 5 and 6, a lock protrusion 23 is provided at an operation side end portion having the other end 20*c* of the link member 20 of this embodiment. Further, a locking part 24 to which the lock protrusion 23 can be locked is provided on the guide portion 19 situated at a position corresponding thereto.

When detaching or mounting the cartridge 5*a*, the operator opens the door 16. The operator grasps the operation side end portion 20*c* of the link member 20, and, as illustrated in FIG. 5, detaches the lock protrusion 23, which has been locked to the locking part 24. As a result, the link member 20 rotates to attain the state as illustrated in FIG. 5 due to the elastic force of the spring 31, whereby the lock of the cartridge by the lock member 18 is released. In this state, it is possible to detach or mount the cartridge 5*a*.

After mounting the cartridge 5*a* to the mounting portion 50*a*, the operator grasps the operation side end portion 20*c* of the link member 20, and rotates the operation side end portion 20*c* so as to move it upwardly, whereby the lock protrusion 23 is locked to the locking part 24. As a result, the lock member 18 is urged by the elastic force of the compression spring 30 to rotate clockwise (FIG. 6) to lock the cartridge 5*a* to the mounting portion 50*a* (the rotary 1).

As described above, according to this embodiment, to release the lock member 18 by the link member 20, the operator operates the link member 20 manually after moving the door 16 from the closed position to the opening position. As a result, the lock member 18 rotates about the fulcrum 18*a*, and the link member 20 pushes the lock member 18 such that the lock member 18 is separated from the lock engagement portion (locked portion) 17 of the cartridge 5. Then, the locked state of the cartridge 5 is canceled.

In the above-mentioned embodiments, the above-mentioned structure is provided at both one end and the other end in the longitudinal direction of the rotary 1 (see FIGS. 8 and 9). Thus, in the above-mentioned embodiments, it is possible to lock one end and the other end in the longitudinal direction of the cartridge 5 by the lock member 18. Thus, locking with respect to the rotary 1 can be effected more reliably. However, the present invention is not restricted to the construction in which the above-mentioned structure is provided at both one end and the other end in the longitudinal direction of the rotary 1. For example, it is also possible for the above-mentioned structure to be provided at one of one end and the other end or at the central portion in the longitudinal direction.

In FIGS. 8 and 9, a part of the construction is omitted.

According to this embodiment, the lock member 18 can be operated via the link member 20. The operation side end portion 20*c* of the link member 20 is situated in the vicinity of the opening portion 40, whereby the operation of locking and releasing the lock of the cartridge can be easily conducted by the operator from the opening portion 40.

According to the above-mentioned embodiments, the locking means for locking the cartridge to the mounting portion can be operated by the link means. An end portion of this link means is situated in the vicinity of the opening portion. Thus, even when the locking means is at the depth side of the apparatus, the locking means can be easily operated by the link means from the vicinity of the opening portion. Thus, it is possible to reduce the size of the apparatus. Further, even when the locking means of the developing cartridge is provided at a position that is difficult for the operator to access, the operation of locking the cartridge to the apparatus main body can be conducted easily.

Further, according to the above-mentioned embodiments, it is possible to achieve a reduction in apparatus size and to facilitate the operation of locking the developing cartridge to the apparatus main body even in the case of an image forming apparatus in which it is difficult to secure a large opening portion for allowing mounting and detachment of the developing cartridge to the apparatus main body.

Further, according to the above-mentioned embodiments, it is possible to achieve a reduction in apparatus size and to facilitate the operation of locking the developing cartridge to the apparatus main body even in the case of a construction in which the developing cartridge is inserted through a small opening and mounted to the depth side of the apparatus main body.

Other Embodiments

The above-mentioned embodiments are applied to a four-color rotary development type image forming apparatus. However, the above-mentioned cartridge locking/unlocking system of the present invention is also applicable to a tandem type image forming apparatus in which developing devices are arranged side by side. Further, it is applicable not only to a color image forming apparatus but also to a monochrome image forming apparatus having only one developing device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-128985, filed May 15, 2007, and No. 2008-112001, filed Apr. 23, 2008, which are hereby incorporated by reference herein in their entirety.

What is claimed is:

1. An electrophotographic image forming apparatus in which a developing cartridge for developing an electrostatic latent image formed on an electrophotographic photosensitive member is detachably mounted to a mounting portion, the electrophotographic image forming apparatus comprising:

an opening portion through which the developing cartridge is passed when mounting the developing cartridge to the mounting portion and when detaching the developing cartridge from the mounting portion;

an openable and closable member movable between an opening position at which the opening portion is opened and a closed position at which the opening portion is closed;

a lock member which releasably locks the developing cartridge to the mounting portion to which the developing cartridge has been mounted; and a releasing member acting on the lock member to release the lock of the developing cartridge portion by the lock member, wherein, in releasing the lock by the releasing member, the openable and closable member is moved from the closed position to the opening position by a user, whereby the releasing member pushes the lock member so that the lock member rotates about a fulcrum and is separated from a locked portion of the developing cartridge, wherein the developing cartridge has a developing roller for supplying developer to the electrophotographic photosensitive member to develop an electrostatic latent image formed on the electrophotographic photosensitive member, a positioned portion provided coaxially with the developing roller to position the developing cartridge with respect to the mounting portion, and the locked portion engaged with the lock member when the developing cartridge is mounted to the mounting portion, wherein the locked portion is provided on a lower surface of the developing cartridge, when the developing cartridge is mounted to the mounting portion, and wherein the locked portion is provided on a downstream side of the developing roller in a mounting direction in which the developing cartridge is mounted to the mounting portion.

2. An electrophotographic image forming apparatus according to claim 1, comprising a main body member integrally having the positioned portion and a regulating portion for regulating a range in which the lock member rotates in a direction opposite to a direction in which the lock member locks the developing cartridge to the mounting portion.

3. An electrophotographic image forming apparatus according to claim 2, comprising a plurality of mounting portions provided on a rotary rotatably provided in a main body of the electrophotographic image forming apparatus, wherein the developing cartridge is detachably mounted to one of the plurality of mounting portions and moved, in accordance with a rotation of the rotary, to a developing position in which the developing cartridge is opposed to the electrophotographic photosensitive member.

4. A color electrophotographic image forming apparatus which forms an image on a recording medium, the color electrophotographic image forming apparatus comprising:

an electrophotographic photosensitive drum;

developing cartridges, each of which develops an electrostatic latent image formed on the electrophotographic photosensitive drum, the developing cartridges each having a developing roller which supplies developer to the electrophotographic photosensitive member to develop the electrostatic latent image formed on the electrophotographic photosensitive member, a positioned portion provided coaxially with the developing roller to position one of the developing cartridges with respect to a mounting portion, and a locked portion engaged with a lock member when one of the developing cartridges is mounted to the mounting portion;

a rotary which has a plurality of mounting portions to which the developing cartridges are detachably mounted, respectively, and which rotates with the developing cartridges mounted to the plurality of mounting portions to thereby successively move the developing cartridges to a developing position at which the electrostatic latent image is developed;

an opening portion through which one of the developing cartridges is passed when the one of the developing cartridges is mounted to one of the mounting portions and when the one of the developing cartridges is detached from the one of the mounting portions;

an openable and closable member movable between an opening position where the opening portion is opened and a closed position where the opening portion is closed;

lock members releasably locking the developing cartridges to the mounting portions to which the developing cartridges have been mounted, respectively; and a releasing member which acts on one of the lock members to release the lock of one of the developing cartridges locked to one of the mounting portions by the one of the lock members, the releasing of the lock by the releasing member being effected through a manual operation of the releasing member after a user moves the openable and closable member from the closed position to the opening position to thereby cause the releasing member to push the one of the lock members so that the one of the lock members rotates about a fulcrum and moves away from a locked portion of the one of the developing cartridges, wherein the locked portion is provided on a lower surface of the one of the developing cartridges, when the one of the developing cartridges is mounted to the one of the mounting portions, and wherein the locked portion is provided on a downstream side of the developing roller with respect to a mounting direction in which the developing cartridges are mounted to the mounting portions.

5. A color electrophotographic image forming apparatus which forms an image on a recording medium, the color electrophotographic image forming apparatus comprising:

an electrophotographic photosensitive drum;

developing cartridges, each of which develops an electrostatic latent image formed on the electrophotographic photosensitive drum, the developing cartridges each having a developing roller which supplies developer to the electrophotographic photosensitive member to develop the electrostatic latent image formed on the electrophotographic photosensitive member, a positioned portion provided coaxially with the developing roller to position one of the developing cartridges with respect to a mounting portion, and a locked portion engaged with a lock member when one of the developing cartridges is mounted to the mounting portion;

a rotary which has a plurality of mounting portions to which the developing cartridges are detachably mounted, respectively, and which rotates with the developing cartridges mounted to the plurality of mounting portions to thereby successively move the developing cartridges to a developing position at which the electrostatic latent image is developed;

an opening portion through which one of the developing cartridges is passed when the one of the developing cartridges is mounted to one of the mounting portions and when the one of the developing cartridges is detached from the one of the mounting portions;

an openable and closable member movable between an opening position where the opening portion is opened and a closed position where the opening portion is closed;

lock members releasably locking the developing cartridges to the mounting portions to which the developing cartridges have been mounted, respectively; and a releasing member which acts on one of the lock members to release the lock of one of the developing cartridges locked to one of the mounting portions by the one of the lock members, the releasing of the lock by the releasing members being effected through an operation of moving the openable and closable member from the closed position to the opening position by a user to thereby cause the releasing member to push the one of the lock members so that the one of the lock members rotates about a fulcrum and moves away from a locked portion of the one of the developing cartridges, wherein the locked portion is provided on a lower surface of the one of the developing cartridges, when the one of the developing cartridges is mounted to the one of the mounting portions, and wherein the locked portion is provided on a downstream side of the developing roller with respect to a mounting direction in which the developing cartridges are mounted to the mounting portions.

6. A color electrophotographic image forming apparatus according to claim 5, wherein the releasing member pushes one of the lock members to act on the one of the lock members, and wherein, in this connection, a portion of the releasing member to be pushed by a protruding member provided so as to protrude from an inner side of the openable and closable member and a portion of the protruding member for pushing the releasing member are formed in a shape of a circular arc.

* * * * *